US009570846B2

(12) United States Patent
Lueckemeier

(10) Patent No.: US 9,570,846 B2
(45) Date of Patent: Feb. 14, 2017

(54) PLUG-TYPE CONNECTOR HAVING PLUG-IN FORCE LIMITATION

(71) Applicant: HARTING Electronics GmbH, Espelkamp (DE)

(72) Inventor: Martin Lueckemeier, Rahden (DE)

(73) Assignee: HARTING ELECTRONICS GMBH (DE)

( * ) Notice: Subject to any disclaimer, the term of this patent is extended or adjusted under 35 U.S.C. 154(b) by 0 days.

(21) Appl. No.: 14/916,540

(22) PCT Filed: Dec. 3, 2014

(86) PCT No.: PCT/DE2014/100423

§ 371 (c)(1),
(2) Date: Mar. 3, 2016

(87) PCT Pub. No.: WO2015/081929

PCT Pub. Date: Jun. 11, 2015

(65) Prior Publication Data

US 2016/0294115 A1 Oct. 6, 2016

(30) Foreign Application Priority Data

Dec. 6, 2013 (DE) ..... 10 2013 113 631

(51) Int. Cl.
*H01R 13/627* (2006.01)
*H01R 13/633* (2006.01)
*H01R 13/641* (2006.01)

(52) U.S. Cl.
CPC ..... *H01R 13/6275* (2013.01); *H01R 13/6335* (2013.01); *H01R 13/641* (2013.01)

(58) Field of Classification Search
CPC ..... H01R 13/5219; H01R 13/6275; H01R 13/641; H01R 13/6335
(Continued)

(56) References Cited

U.S. PATENT DOCUMENTS 3,964,771 A 6/1976 Baudouin ..... 285/315
5,316,494 A * 5/1994 Flanagan ..... H01R 13/627 439/352
(Continued)

FOREIGN PATENT DOCUMENTS

DE 2447088 4/1975 ..... F16B 21/16
DE 202006005177 6/2006 ..... H01R 13/52
(Continued)

OTHER PUBLICATIONS

International Preliminary Report on Patentability issued in application No. PCT/DE2014/100423, dated Jun. 16, 2016 (8 pgs).
(Continued)

*Primary Examiner* — Abdullah Riyami
*Assistant Examiner* — Harshad Patel
(74) *Attorney, Agent, or Firm* — Hayes Soloway P.C.

(57) ABSTRACT

Disclosed is a plug connector, known as a push-pull type of plug connector, wherein the plug connector is embodied from a base body for receiving a contact, a latch and also a first actuator for actuating the latching means. The first actuator is provided on the plug connector in such a manner that it can be displaced axially along the plugging direction. The first actuator is used for transferring the plugging force by the user to the plug connector, wherein the strengths of the force is limited to a defined maximum in order to prevent damage to components. Furthermore, the latch is actuated by displacing the first actuator in the opposite direction to the plugging direction and the latching arrangement with respect to the mating plug connector is released.

19 Claims, 6 Drawing Sheets

Figure 1:
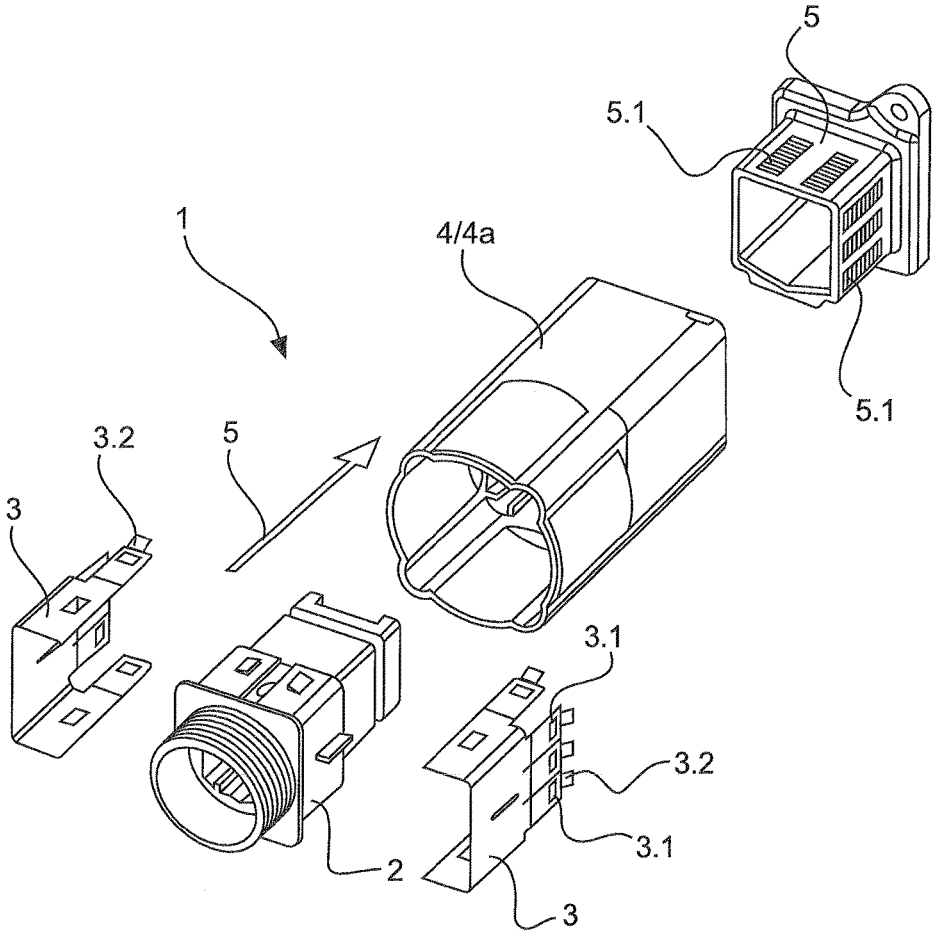

(58) Field of Classification Search
USPC ..... 439/352, 353–358, 578–595, 361, 362, 439/345
See application file for complete search history.

(56) References Cited

U.S. PATENT DOCUMENTS

| | | | | |
|---|---|---|---|---|
| 6,093,043 | A * | 7/2000 | Gray | H01R 13/622 439/352 |
| 6,491,542 | B1 | 12/2002 | Zerebilov | 439/489 |
| 7,335,047 | B2 | 2/2008 | Bernat et al. | 439/350 |
| 7,351,088 | B1 | 4/2008 | Qu | 439/352 |
| 7,553,185 | B1 * | 6/2009 | Qu | H01R 13/5219 439/578 |
| 7,785,146 | B2 | 8/2010 | Chazottes et al. | 439/595 |
| 8,087,954 | B2 * | 1/2012 | Fuchs | H01R 13/5219 439/352 |
| 8,944,838 | B2 * | 2/2015 | Mulfinger | G02B 6/3893 439/349 |
| 9,048,599 | B2 * | 6/2015 | Burris | H01R 24/38 |
| 9,153,911 | B2 * | 10/2015 | Burris | H01R 13/6581 |
| 9,385,446 | B2 * | 7/2016 | Palinkas | H01R 9/0527 |
| 2015/0016779 | A1 | 1/2015 | Schmidt et al. | 385/65 |

FOREIGN PATENT DOCUMENTS

| | | | |
|---|---|---|---|
| DE | 102012100615 | 7/2013 | G02B 6/36 |
| EP | 1906492 | 4/2008 | H01R 13/52 |
| FR | 2875957 | 3/2006 | H01R 13/639 |

OTHER PUBLICATIONS

German Office Action issued in application No. 10 2013 113 631.1, dated Aug. 6, 2014 (6 pgs).
International Search Report and Written Opinion issued in application No. PCT/DE2014/100423, dated Apr. 2, 2015 (13 pgs).

* cited by examiner

PLUG-TYPE CONNECTOR HAVING PLUG-IN FORCE LIMITATION

BACKGROUND OF THE INVENTION

Plug connectors are required in order to connect lines for signals or power to one another. The present invention relates to a plug connector for preferably electrical or optical fibre lines. Both signals and information as well as power in the form of by way of example electrical voltage or pneumatic pressure can be transmitted by way of plug connectors—and lines—of this type.

The invention relates preferably to a so-called push-pull plug connector. This generic type of plug connectors is contacted by means of merely plugging the plug onto a mating plug and latches automatically with said mating plug. The latching arrangement with the mating plug connector is released and a disconnecting procedure is possible by means of pulling on the plug connector. This is known as a push-pull plug connector owing to it being simple to handle by means of plugging and unplugging the plug connector.

A plurality of so-called push-pull plug connectors is already known from the prior art. All disclosed solutions have the common feature that when plugging the plug connector onto the mating plug connector, a latching point is achieved at which the latching arrangement of the plug connector is noticeable and usually also audible. It is consequently clearly evident whether the plug connector is securely latched to the mating plug connector or not.

The publication DE 24 47 088 A1 discloses a coupling that describes a connection between a stationary part and a moving part by means of a ball that engages in a mounting arrangement. A slider holds the ball in the mounting arrangement or releases said ball from the mounting arrangement so as to release the connection.

The publication DE 20 2006 005 177 U1 discloses a metal plug connector that can latch into a mating plug connector by means of latching metal sheets having connecting hooks that are located on said latching metal sheets. The latching metal sheets can be raised and the connecting hooks can be lifted from the mating plug connector by means of a displaceable, non-detachable sleeve that can be displaced on the plug connector, whereby the interlocking arrangement of the plug connector is released.

The disadvantage in the case of plug connectors disclosed in the prior art is that said plug connectors are designed for a simple interlocking arrangement that do not recognize an interlocked and a non-interlocked state.

The publication DE 10 2012 100 615 A1 discloses a plug connector system comprising multiple staggered latching units that can likewise be unlatched by means of a sliding mechanism. A difference in the depth of engagement between the contact means of a plug connector and a mating plug connector can be compensated for by means of the staggered latching units or also known as latching stages or latching points.

In the case of plug connectors that comprise multiple latching stages or latching points in order by way of example to compensate for a difference in length between the contact means of plug connectors and mating plug connectors, it is not clearly evident to the user whether the latching arrangement has been correctly actuated or whether it is necessary to push one latching stage further on.

This is particularly disadvantageous if an excessive pushing force causes the contact means of the plug connector and the contact means of the mating plug connector to be pushed too far over one another and as a result to become damaged. It is essential to avoid the contact means or other components of the plug connectors becoming damaged and impaired.

SUMMARY OF THE INVENTION

The object of the invention is to embody a plug connector in such a manner that damage and impairment to the contact means and components of the plug connector are avoided during the plugging procedure. In addition, it is to be prevented that the contact means can be pushed on too far. It is to be ensured that force-regulating devices of the plug connector in the unplugged state of the plug connector cannot be intentionally or unintentionally manipulated.

The invention is a plug connector of the type described in the introduction, said plug connector also being known as a so-called push-pull plug connector. In this specific, described variant, the invention relates to plug connectors of this type that comprise more than one latching stage or one latching point.

This advantageous embodiment of plug connectors renders it possible to compensate for a difference in length between the contact means of plug connector and the mating plug connector that is to be contacted. Depending upon the magnitude of the tolerances of the components of the plug connectors—and said tolerances can vary considerably from manufacturer to manufacturer—the difference can be compensated for by means of a variable latching arrangement of the plug connector.

In accordance with the invention, the plug connector comprises a force limit that renders it possible for the user to bring the plug connector into contact with the mating plug connector only with a defined force. It is thus rendered possible to compensate for a difference in length between the plug connector and the mating plug connector and simultaneously it is ensured that no components are damaged as a result of an excessive contacting force.

For this purpose, the plug connector comprises a second actuating means by means of which it is possible for the user to slide the plug connector onto the mating connector and form a contact arrangement. The force that is exerted on the second actuating means by means of the user is transferred to the plug connector by means of carriers on the second actuating means and base body.

The carriers are expediently embodied on the second actuating means and the base body of the plug connector in such a manner that said second actuating means engage into one another and transfer the force from the second actuating means to the base body. The transfer of force is limited to a specific value—in dependence upon the incline of the ramps—by means of a specific embodiment of the carriers as ramps.

If the defined force is exceeded, the ramps slide over one another and the second actuating means that can be displaced axially in the plugging direction is pushed onto the mating plug connector as far as a stop without having to transfer further force onto the plug connector. It is not possible to push the plug connector and mating plug connector further onto one another.

It is thus possible to prevent damage or impairment to the contact means, and also to other components of the plug connector and mating plug connector.

Furthermore, the plug connector in accordance with the invention comprises all further components that are already known from the prior art from similar plug connectors. In addition to a latching means that can be latched in latches of the mating plug connector, the plug connector comprises a first actuating element that can be displaced axially in the opposite direction to the plugging direction of the plug connector.

This first actuating means raises the latching means of the plug connector from the latches of the mating plug connector by means of corresponding, previously known formations or moldings. It is thus possible to release the latching arrangement between the plug connectors.

In a specific embodiment, the two actuating means—the previously known first actuating means for unlatching the interlocking arrangement and the second actuating means for locking the plug connector—are formed as one part. The plug connector thus only comprises one actuating means that is used so as to provide and to remove a contact arrangement of the plug connectors.

In a further specific embodiment, the second actuating means surrounds the plug connector in a sleeve-like manner in such a manner that the plug connector can only be grasped by the user on the second actuating means. It is thus not possible to apply an excessive plugging force to the plug connector and mating plug connector.

The plug connector in accordance with the invention comprises in addition a blocking element that prevents the force limit of the second actuating means being undesirably triggered in the non-plugged state. For this purpose, the blocking element blocks the movement of the second actuating means in the plugging direction and only allows said movement if a mating plug connector is connected to the plug connector.

The advantages that are achieved by the invention are essentially that a plug connector system comprising plug connectors and mating plug connectors having variable plug-in depths can no longer be pushed on too far. Damage to contacts or components of the plug connector can thus be prevented. Furthermore, it can be ensured that the minimum required plugging forces are provided. By virtue of plugging in the plug connector "until the force limit is triggered", it is possible in the case of suitably selected force values to ensure a minimum plugging force whilst simultaneously not exceeding the maximum plugging force.

BRIEF DESCRIPTION OF THE INVENTION

Figure 2A:
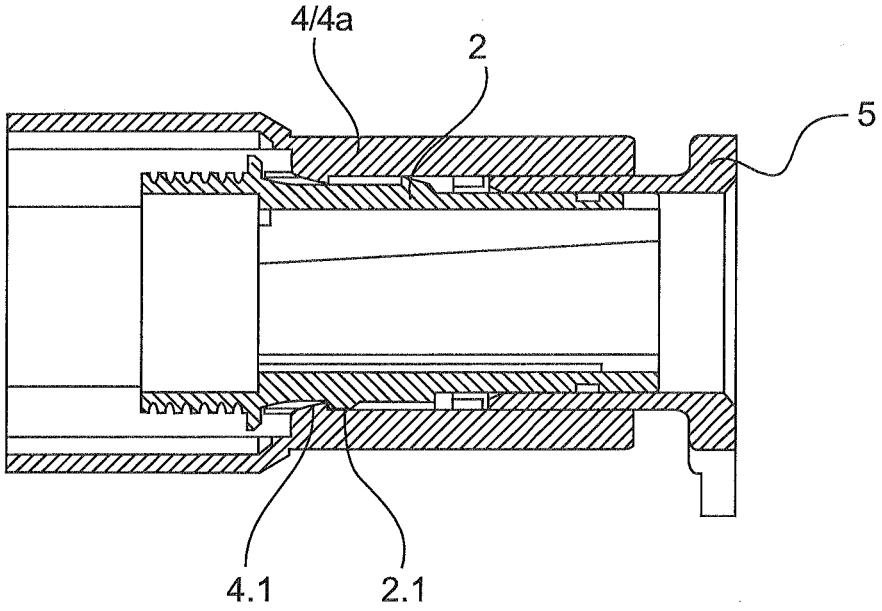
Figure 3A:
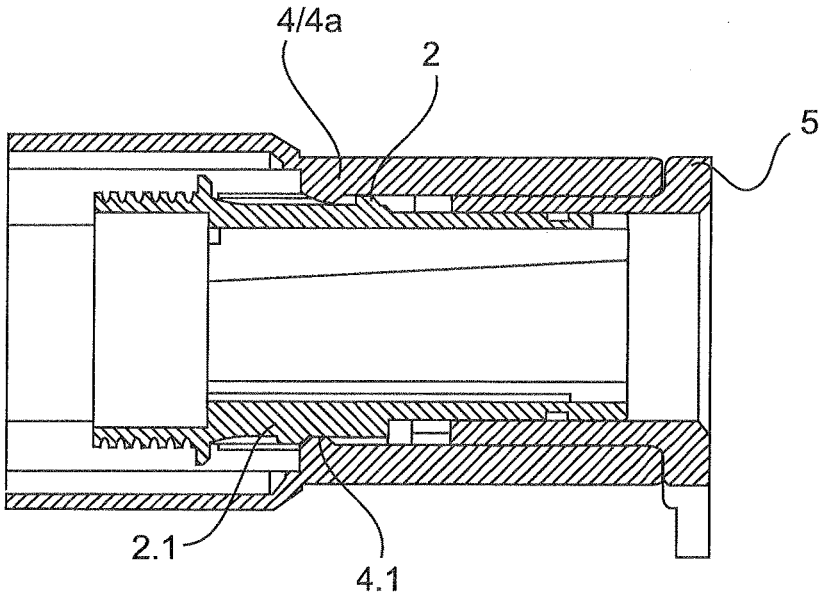
Figure 4A:
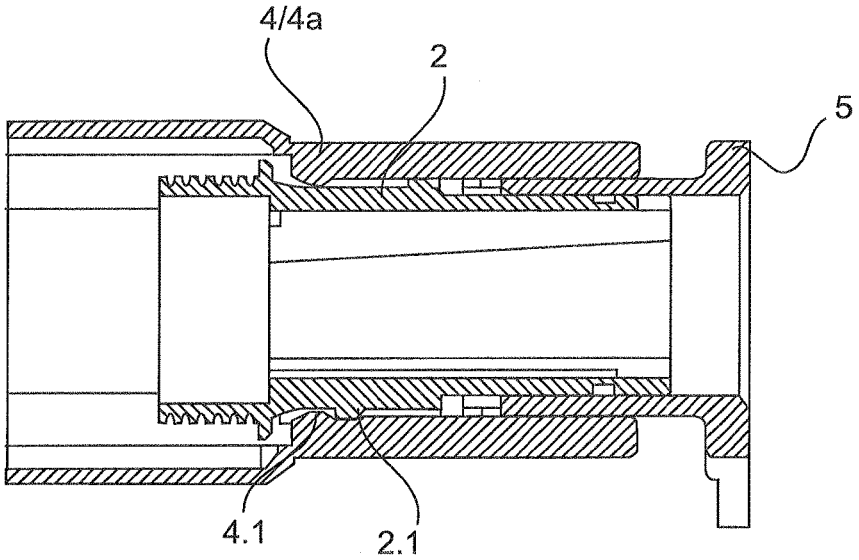
Figure 5:
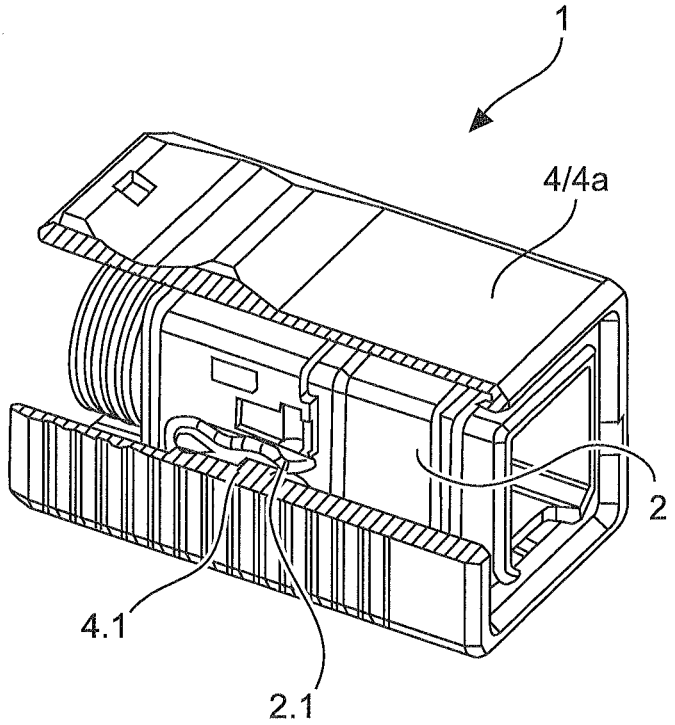
Figure 6:
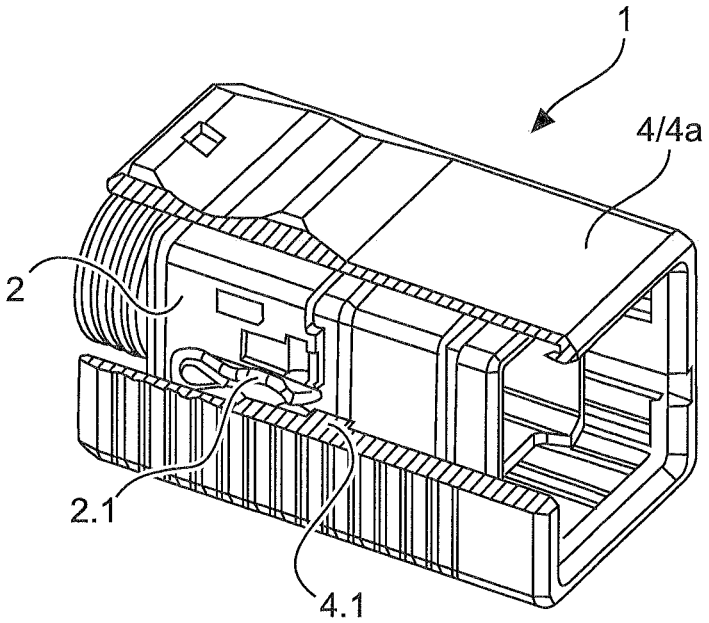
Figure 7:
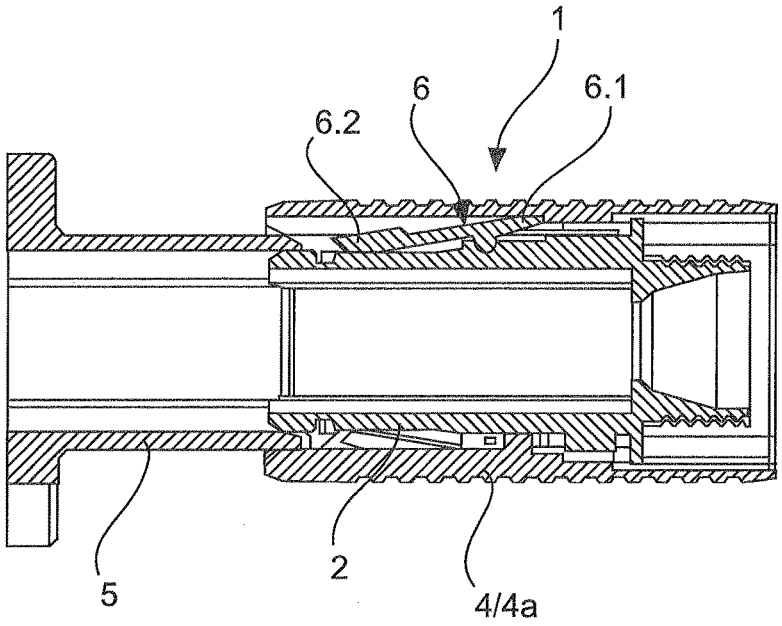
Figure 8:
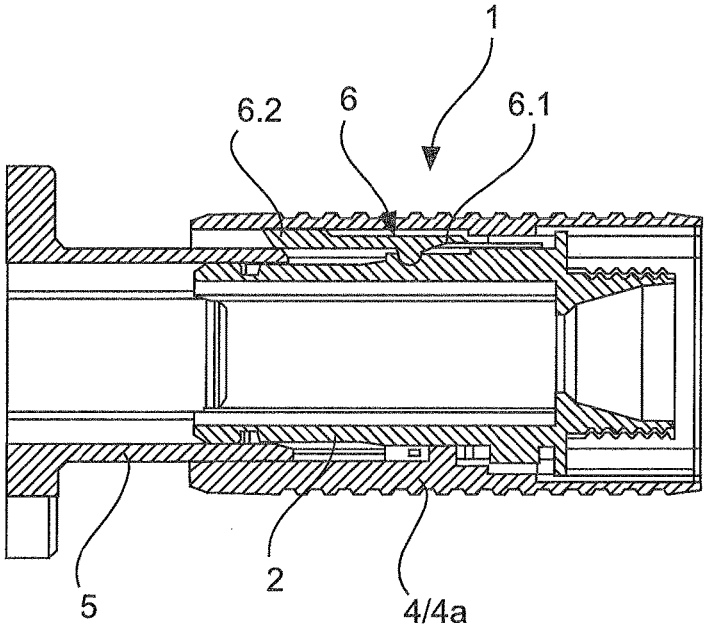

An exemplary embodiment of the invention is illustrated in the drawings and further explained hereinunder. In the figures:

FIG. 1 illustrates an exploded view of a plug connector,

FIG. 2*a*/2*b* illustrates a sectional view of the plug connector in the initial state, FIG. 3*a*/3*b* illustrates a sectional view of the plug connector in the force-limiting state, FIG. 4*a*/4*b* illustrates a sectional view of the plug connector in the unlocking state, FIG. 5 illustrates a part view of the plug connector in the initial state, FIG. 6 illustrates a part view of the plug connector in the force-limiting state, FIG. 7 illustrates a sectional view of the plug connector having a blocking element in the non-plugged in state, and FIG. 8 illustrates a sectional view of the plug connector having a blocking element in the plugged in state.

DETAILED DESCRIPTION OF THE INVENTION

FIG. 1 illustrates a plug connector 1 in accordance with the present invention in an exploded view. The most important components of the plug connector 1 are illustrated: a base body 2, in this case two latching means 3, and also the first actuating means 4 and the second actuating means 4*a* that are embodied in this specific embodiment as one part. In addition, a mating plug connector 5 is illustrated.

For the sake of clarity, only the receiving flange of the mating plug connector 5 is illustrated. The rest of the components are not relevant as far as the invention is concerned and can be omitted in this case. Furthermore, the illustrated receiving flange is described as representative of the mating plug connector 5.

The base body 2 comprises a plugging side and also a connecting side. The plugging side that is facing in the plugging direction S corresponds to the receiving recess of the mating plug connector 5. The base body 2 and the mating plug connector 5 are provided so as to receive contact elements that can be contacted by one another. For the sake of clarity, the illustration of the contact elements is omitted in the figures. Said contact elements are not dependent on the present invention and can vary according to the prior art. Suffice to say that the contact elements can be of the electrical, pneumatic, optical fibre or hydraulic type.

In the specific, illustrated embodiment, two latching elements 3 are provided that are fastened to the base body 2. The latching means 3 that are illustrated on the left-hand side and right-hand side of the base body 2 comprise resilient latching arms on whose ends are provided in each case latching hooks 3.1 and also unlatching lugs 3.2.

The latching hooks 3.1 of the latching means 3 are provided in order to latch in latching recesses 5.1 in the mating plug connector 5. The mating plug connector 5 comprises multiple latching regions that are formed from multiple latching recesses 5.1. Depending upon the extent of the depth to which the plug connector 1 is plugged into the mating plug connector 5, the latching hooks 3.1 latch in latching recesses 5.1 that lie further forwards or further to the rear.

The unlatching lugs 3.2 that are provided on the latching means 3 are provided so as to unlock the plug connector 1 and the mating plug connector 5. Said latching means are raised on the inner side of the first actuating means 4 by means of corresponding unlatching inclines 4.2 if the first actuating means 4 is actuated in the opposite direction to the plugging direction S.

The unlatching inclines 4.2 engage below the unlatching lugs 3.2 and thus raise the latching arms by means of actuating the first actuating means 4 in the opposite direction to the plugging direction S. This causes the latching hooks 3.1 to lift out of the latching receiving recesses 5.1, whereby the plug connector 1 and the mating plug connector 5 are released. This corresponds to the push-pull principle that is known and common in the prior art.

As is previously mentioned, in this specific embodiment, the first actuating means 4 and the second actuating means 4*a* are embodied as one part. It is possible to limit the force in accordance with the invention in the plugging procedure by means of the second actuating means 4*a*. This principle is more evident and is better illustrated in the sectional views of FIG. 2 to FIG. 4.

Figure 2B:
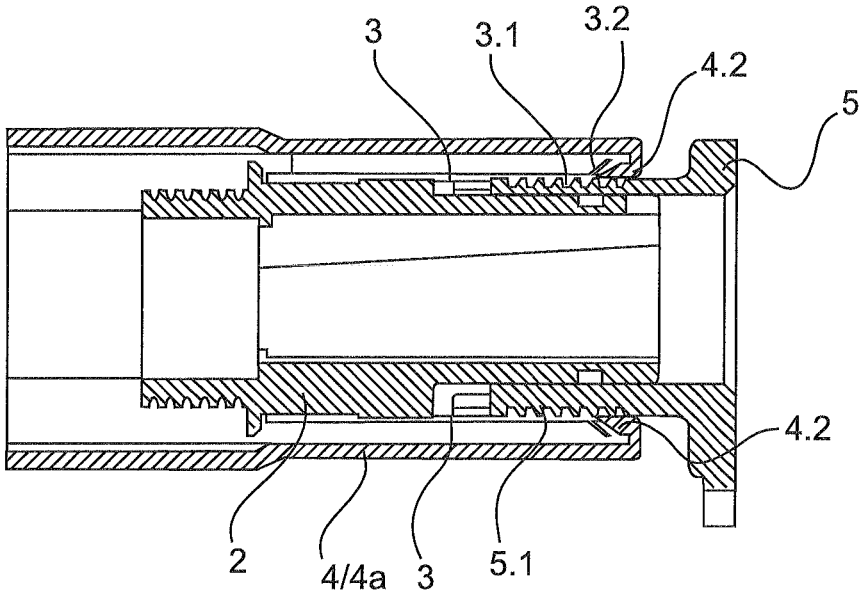
Figure 3B:
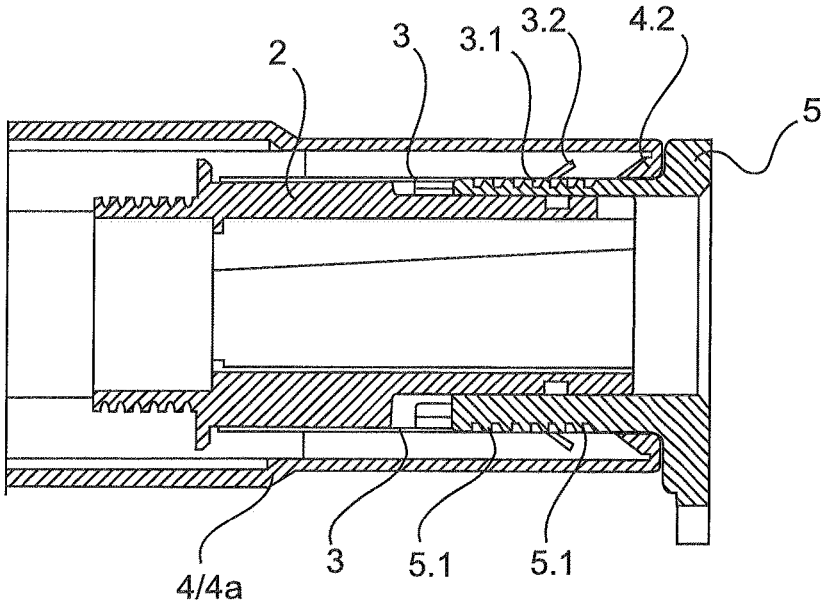
Figure 4B:
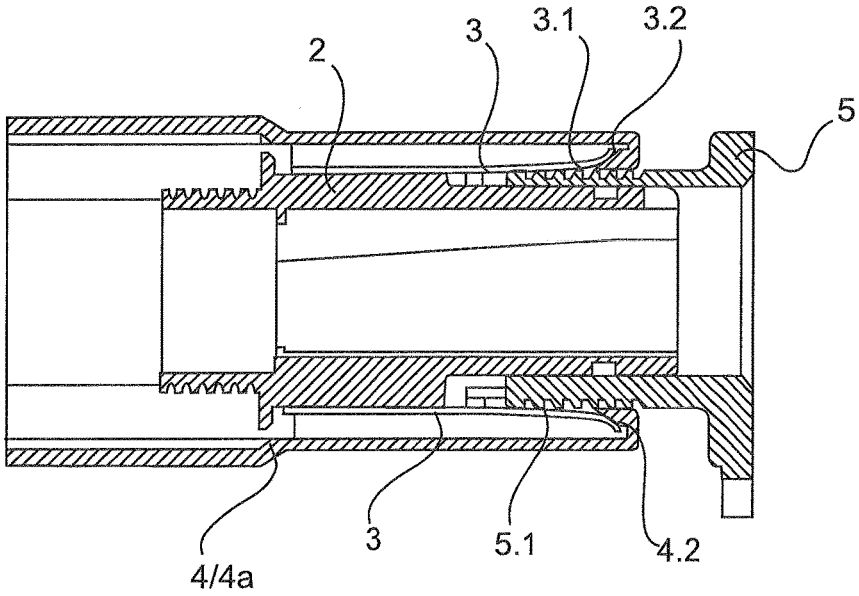

FIG. 2 to FIG. 4 illustrate in each case the plug connector 1 of FIG. 1 in a sectional view. The views in FIGS. 2*a*, 3*a* and 4*a* in each case are cut in the plane of the carrier 2.1/4.1 and the views of FIGS. 2*b*, 3*b* and 4*b* in each case are cut in the plane of the latching hooks 3.1 and unlatching lugs 3.2 and also the unlatching inclines 4.2 and the latching recesses 5.1.

FIG. 2*a* and FIG. 2*b* illustrate the plug connector in a locked initial state. The latching hooks 3.1 latch in latching recesses 5.1 of the mating plug connector 5. The plug connection is thus prevented from being released.

It is possible by means of the second actuating means 4*a* to push the plug connector 1 further onto the mating plug connector 5. The carriers 4.1 that are formed on the second actuating means 4*a* (only one carrier 4.1 is visible in the sectional view), transfer a force that is exerted on the second actuating means 4*a* to the carriers 2.1 (likewise only one carrier 2.1 is visible in the sectional view) of the base body 2.

It is thus rendered possible to further slide the plug connector 1 and the mating plug connector 5 into one another. Depending upon the extent to which said plug connector and mating plug connector are slid into one another, the latching hooks 3.1 latch in latching recesses 5.1 of the mating plug connector 5 that lie further forwards or further to the rear.

If, in the further plugging procedure, the defined plugging force is exceeded, the carriers 4.1 and 2.1 slide over one another by means of resilient deformation of the second actuating means 4*a* and also of the base body 2. A further transfer of force to the base body 2 is prevented. This state is illustrated in FIG. 3*a* and FIG. 3*b*.

The carriers 4.1 and 2.1 have slid over one another and force is transferred to the base body 2 and consequently the plug connector 1 and the mating plug connector 5 are prevented from being further plugged in. The second actuating means 4*a* can be pushed to the maximum extent as far as the mating plug connector 5, as is illustrated in FIG. 3*a* and FIG. 3*b*.

The base body 2 of the plug connector 1 is latched to the mating plug connector 5 in this state independently of the plugging forces of the second actuating means 4*a*.

In order to cause the plug connector 1 and mating plug connector 5 to unlock, it is necessary for the first actuating means 4 to be moved in the opposite direction to the plugging direction S. It is necessary to apply a specific force in order to bring the carriers 4.1/2.1 back into the initial position in FIG. 2*a*/FIG. 2*b*.

The first actuating means 4 can then be moved further in the opposite direction to the plugging direction S (FIG. 4A and FIG. 4*b*) until the unlatching inclines 4.2 engage below the unlatching lugs 3.2 of the latching means 3 and raise said unlatching lugs radially towards the exterior. The latching hooks 3.1 are raised out of the latching recesses 5.1 by means of the unlatching inclines 4.2 and the unlatching lugs 3.2 and thus release the locking arrangement between the plug connector 1 and mating plug connector 5. It is possible to pull the plug connector 1 from the mating plug connector 5.

FIG. 5 illustrates a further plug connector in accordance with the invention in the initial state—as in FIGS. 2*a* and 2*b*—but having a further embodiment of the carriers 2.1, 4.1. The carrier 2.1 is embodied by means of a resilient clamp. The resilient clamp is fixed to a pin on the base body 2. The carrier 4.1 is implemented as a pin. This extends in an eye of the carrier 2.1 that is embodied as a resilient clamp. As a consequence, it is possible to unlock the plug connector 1 and the mating plug connector 5.

In the case of excessive actuating force from the second actuating means 4*a* on the base body 2 in the plugging direction, the carrier 2.1 that is embodied as a resilient clamp is widened by the carrier 4.1 and the carrier 4.1 slides in the plugging direction out of the eye of the carrier 2.1. This force-limited state is illustrated in FIG. 6. The figure illustrates the carrier 4.1 that is located in the plugging direction upstream of the carrier 2.1.

FIGS. 7 and 8 illustrate in each case in a sectional view of the plug connector 1 the function in accordance with the invention of a blocking element 6. For this purpose, FIG. 7 illustrates the plug connector 1 in a non-plugged state. The figure illustrates the blocking element 6 that is embodied in this embodiment as a rocker and is mounted in the base body 2.

A first region of the blocking element 6 is provided as a blocking region 6.1, while the second region of the blocking element 6 forms a lever region 6.2. In the non-plugged state, the lever region 6.2 lies in the plugging region of the mating plug connector 5. The blocking region 6.1 is located in the movement path of the second actuating means 4*a*. It is thus not possible for the second actuating means 4*a* to move in the plugging direction.

The lever region 6.2 is raised by means of plugging a mating plug connector 5 into the plugging region of the plug connector 1. The blocking region 6.1 is thus pivoted out of the movement path of the second actuating means 4*a* by means of rotating the blocking element 6. This plugged state is illustrated in FIG. 8.

The lever region 6.2 of the blocking element 6 has been levered out of the plugging region by the mating plug connector 5. As a consequence, the blocking region 6.1 has been moved out of the movement path of the second actuating means 4*a*. When achieving a maximum plugging force, the force limit according to FIGS. 2*a*-3*a* or the FIGS. 5-6 can be triggered without the blocking region 6.1 of the blocking element 6 blocking the second actuating means 4*a*.

Plug Connector Having a Plugging Force Limit

LIST OF REFERENCE NUMERALS

1 Plug connector
2 Base body
2.1 Carrier
3 Latching means
3.1 Latching hook
3.2 Unlatching lug
4 First actuating means
4*a* Second actuating means
4.1 Carrier
4.2 Unlatching incline
5 Mating plug connector
5.1 Latching recess
6 Blocking element
6.1 Blocking region
6.2 Lever region
S Plugging direction

The invention claimed is:

1. A plug connector comprising a base body, at least one latch and also a first actuator and a second actuator, wherein the base body is provided so as to receive a contact and the at least one latch are provided so as to lock the plug connector to a mating plug connector, wherein the first actuator is arranged on the base body in such a manner that said first actuator can be displaced axially in a plugging direction (S) and the first actuator when being displaced in an opposite direction to the plugging direction (S) acts with a force upon the at least one latch in such a manner that a locking arrangement with respect to the mating plug connector is released, wherein an axial force that acts in the plugging direction (S) can be transferred to the base body by the second actuator, wherein the force that can be transferred from the second actuator to the base body is limited, wherein the second actuator is arranged on the base body of the plug connector in such a manner that it can be displaced axially in the plugging direction (S), and wherein the first actuator and the second actuator are embodied as one part, and further wherein a blocking element is provided on the plug connector, said blocking element preventing the second actuator from moving in the plugging direction (S) without the contacted mating plug connector.

2. The plug connector as claimed in claim 1, wherein the second actuator is embodied in a sleeve-like manner and surrounds the base body.

3. The plug connector as claimed in claim 1, wherein the second actuator comprises at least a first carrier and the base body comprises at least a second carrier, wherein the first and second carriers engage in one another in such a manner that the force that acts axially in the plugging direction (S) can be transferred from the second actuator to the base body, wherein the first and second carriers are designed in such a manner that said carriers only engage in one another with a force up to a maximum of 150 N.

4. The plug connector as claimed in claim 3, wherein the force that can be transferred from the second actuator to the base body amounts to a maximum of 120 N.

5. The plug connector as claimed in claim 4, wherein the carriers are embodied as ramp-shaped formations on the base body and the second actuator.

6. The plug connector as claimed in claim 5, wherein in each case a carrier pair is arranged extending over the circumference of the plug connector on the base body and the first actuator as a ring.

7. The plug connector as claimed in claim 4, wherein one of the carriers is embodied as a resilient clamp that is fixed to the base body or to the second actuator, wherein the second of the carriers is embodied as a pin that is fixed accordingly to the second actuator or to the base body, and that the pin can be latched in the resilient clamp.

8. The plug connector as claimed in claim 3, wherein the carriers are embodied as ramp-shaped formations on the base body and the second actuator.

9. The plug connector as claimed in claim 8, wherein in each case a carrier pair is arranged extending over the circumference of the plug connector on the base body and the first actuator as a ring.

10. The plug connector as claimed in claim 8, wherein multiple carrier pairs are arranged distributed over the circumference of the plug connector on the base body and the first actuator.

11. The plug connector as claimed in claim 3, wherein one of the carriers is embodied as a resilient clamp that is fixed to the base body or to the second actuator wherein the second of the carriers is embodied as a pin that is fixed accordingly to the second actuator or to the base body, and that the pin can be latched in the resilient clamp.

12. The plug connector as claimed in claim 11, wherein multiple carrier pairs are arranged distributed over the circumference of the plug connector on the base body and the first actuator.

13. The plug connector as claimed in claim 3, wherein the force that can be transferred from the second actuator to the base body amounts to a maximum of 90 N.

14. The plug connector as claimed in claim 1, wherein multiple latching positions are provided, said latching positions lying axially one behind the other in the plugging direction (S) between the plug connector and the mating plug connector, and the latch can latch in the mating plug connector in said latching positions.

15. The plug connector as claimed in claim 1, wherein the blocking element comprises a blocking region and a lever region.

16. The plug connector as claimed in claim 15, wherein the blocking region in the non-plugged initial state of the plug connector stands in the movement path of the second actuator and prevents the second actuator from moving in the plugging direction.

17. The plug connector as claimed in claim 16, wherein the lever region in the non-plugged initial state of the plug connector protrudes into the plugging region of the mating plug connector.

18. The plug connector as claimed in claim 17, wherein the lever region is embodied so as to be moved by its contacting mating plug connector out of the plugging region of said contacting mating plug connector.

19. The plug connector as claimed in claim 18, wherein the blocking region releases the second actuator by a movement of the lever region out of the plugging region of the mating plug connector.

* * * * *